US005606396A

United States Patent [19]

Yu et al.

[11] Patent Number: 5,606,396

[45] Date of Patent: Feb. 25, 1997

[54] IMAGING PROCESS USING FLEXIBLE ELECTROSTATOGRAPHIC IMAGING MEMBER

[75] Inventors: Robert C. U. Yu, Webster; Geoffrey M. T. Foley, Fairport; Richard L. Post, Penfield; William W. Limburg, Penfield; Youti Kuo, Penfield; Donald C. Von Hoene, Fairport; Satchidanand Mishra, Webster; David H. Pan, Rochester; Yonn K. Rasmussen, Fairport; Dale S. Renfer, Webster; John F. Yanus, Webster; Richard L. Schank, Pittsford, all of N.Y.

[73] Assignee: Xerox Corporation, Stamford, Conn.

[21] Appl. No.: 369,639

[22] Filed: Jan. 6, 1995

[51] Int. Cl.[6] ..... G03G 5/00

[52] U.S. Cl. ..... 399/162; 430/58

[58] Field of Search ..... 355/212; 430/56–58, 430/130

[56] References Cited

U.S. PATENT DOCUMENTS

| | | | |
|---|---|---|---|
| 3,988,399 | 10/1976 | Evans | 264/22 |
| 4,061,222 | 12/1977 | Rushing | 198/807 |
| 4,174,171 | 11/1979 | Hamaker et al. | 355/212 |
| 4,344,693 | 8/1982 | Hamaker | 355/212 |
| 4,532,166 | 7/1985 | Thomsen et al. | 428/57 |
| 4,840,873 | 6/1989 | Kobayashi et al. | 430/273 |
| 4,961,089 | 10/1990 | Jamzadek | 355/207 |
| 4,983,481 | 1/1991 | Yu | 430/59 |
| 5,021,109 | 6/1991 | Petropoulos et al. | 156/137 |
| 5,078,263 | 1/1992 | Thompson et al. | 198/807 |
| 5,089,369 | 2/1992 | Yu | 430/96 |
| 5,167,987 | 12/1992 | Yu | 427/171 |
| 5,187,496 | 2/1993 | Yu | 346/135.1 |
| 5,225,877 | 7/1993 | Wong | 355/212 |
| 5,240,532 | 8/1993 | Yu | 156/137 |
| 5,286,586 | 2/1994 | Foley et al. | 430/56 |
| 5,302,484 | 4/1994 | Odell et al. | 430/127 |
| 5,308,725 | 5/1994 | Yu et al. | 430/56 |
| 5,376,491 | 12/1994 | Krumberg et al. | 430/136 |
| 5,455,136 | 10/1995 | Yu et al. | 430/59 |

FOREIGN PATENT DOCUMENTS

| | | |
|---|---|---|
| 0377318 | 7/1990 | European Pat. Off. . |
| 0549310 | 6/1993 | European Pat. Off. . |

*Primary Examiner*—Robert Beatty

[57] ABSTRACT

An electrostatographic imaging process is disclosed which includes providing a flexible electrostatographic, particularly electrophotographic, imaging belt including a substrate layer, a charge generating layer, charge transport layer, and two parallel longitudinal edges, the imaging belt having a charge transport layer tension strain of less than about 0.05 percent across the width of the belt, mounting the imaging belt on a plurality of spaced apart support rollers, transporting the belt around the support rollers, repeatedly applying a cross belt compression strain distributed in an arcuate gradient of increasing intensity from the longitudinal centerline of the belt to each of the edges of the belt, the strain applied at each of the edges of the belt repeatedly peaking to an intensity at the longitudinal edges of at least about 0.6 percent greater than the strain applied to the centerline of the belt, forming an electrostatic latent image on the belt, developing the electrostatic latent image with toner to form a toner image corresponding to the latent image, transferring the toner image to a receiving member, and repeating the forming, developing and transferring steps at least once. The flexible electrostatographic imaging belt may be fabricated without an anti-curl layer in a continuous process.

9 Claims, 6 Drawing Sheets

IMAGING PROCESS USING FLEXIBLE ELECTROSTATOGRAPHIC IMAGING MEMBER

BACKGROUND OF THE INVENTION

This invention relates in general to a process and more specifically, to a process for preparing and imaging with a flexible electrostatographic imaging member.

Flexible electrostatographic belt imaging members are well known in the art. Typical electrostatographic flexible belt imaging members include, for example, photoreceptors for electrophotographic imaging systems and electroreceptors or ionographic imaging members for electrographic imaging systems. These belts are usually formed by cutting a rectangular sheet from a web, overlapping opposite ends, and welding the overlapped ends together to form a welded seam.

Flexible electrophotographic imaging member belts are usually multilayered photoreceptors that comprise a substrate, an electrically conductive layer, an optional hole blocking layer, an adhesive layer, a charge generating layer, a charge transport layer and an anti-curl backing layer. One type of multilayered photoreceptor comprises a layer of finely divided particles of a photoconductive inorganic compound dispersed in an electrically insulating organic resin binder. U.S. Pat. No. 4,265,990 discloses a layered photoreceptor having separate charge generating (photogenerating) and charge transport layers. The charge generating layer is capable of photogenerating electron—hole pairs and injecting the photogenerated holes into the charge transport layer.

Although excellent toner images may be obtained with multilayered belt photoreceptors, it has been found that as more advanced, higher speed electrophotographic copiers, duplicators and printers were developed, cracking of the charge transport layer and/or welded seam was encountered during cycling or when less durable materials are used. Since cracks in the photoreceptor surface cause print defects in the final copy, their appearance shortens the belt service life. Moreover, seam cracking creates a deposition site where toner, carrier, paper debris, and dirt accumulate and eventually cause premature cleaning blade failure during photoreceptor belt machine cycling.

There is also a great need for long service life flexible belt photoreceptors in compact imaging machines that employ small diameter support rollers for photoreceptor belt systems operating in a very confined space. Small diameter support rollers are also highly desirable for simple, reliable copy paper stripping systems which utilize the beam strength of the copy paper to automatically remove copy paper sheets from the surface of photoreceptor belts after toner image transfer. Unfortunately, small diameter rollers, e.g. less than about 0.75 inch (19 mm) diameter, raise the threshold of mechanical performance criteria to such a high level that photoreceptor belt charge transport layer and/or seam failure due to induced bending stress can become unacceptable for multilayered belt photoreceptor applications.

The welded seam of a belt is formed by passing an ultrasonic welding horn along an overlapped joint at a photoreceptor sheet. The welding operation forms a seam "splash" adjacent to seam. The splash, consists of a molten mixture of charge transport layer, charge generation layer, adhesive layer, charge blocking layer, and anti-curl backing layer materials at the overlapped joint. One of the exposed edges of the seam splash forms a 90 degree angle junction with the surface of the charge transport layer. Under dynamic fatigue conditions, the junction between the splash edge and the charge transport surface layer provides a focal point for stress concentration and becomes a point of mechanical integrity failure in the belt. Dynamic fatigue at this stress concentration point facilitates tear initiation through the charge transport layer. This tear then propagates through the weak charge generating layer/adhesive layer interfacial link to produce local seam delamination.

Also, in liquid development systems, induced bending stress coupled with contact with liquid developers accelerates cracking of the charge transport layer and/or welded seam. Frequent photoreceptor delamination seriously impacts the versatility of a photoreceptor and reduces its practical value for automatic electrophotographic copiers, duplicators and printers.

Typical photoreceptor designs usually require an anti-curl backing layer, coated to the back side of the supporting substrate opposite the electrically operative layers, to provide the desired photoreceptor flatness. Without an anti-curl backing layer, a flexible photoreceptor sheet about 16 inches (40.64 centimeters) in width by 48 inches (121.9 centimeters) in length will spontaneously curl upwardly into a 1½ inch (38.1 millimeters) diameter roll. Although the application of the anti-curl backing layer is solely for the mechanical purpose of counteracting the curl and achieving photoreceptor flatness, the photoreceptor device will possess a substantial internal tensile stress in the charge transport layer as a consequence of the presence of the anti-curl backing layer coating. When cycled in an electrophotographic imaging system employing an active steering roll to control belt walking, the internal stress within the charge transport layer is exacerbated by photoreceptor belt shear stress induced by the steering action of the roll. This steering action leads to the development of ripples in the photoreceptor belt. In a cross section taken transversely of the photoreceptor belt; these ripples resemble a sine wave having an average amplitude of about 7 micrometers with a frequency of periodicity of about 6 ripples per inch belt width, and appear to the naked eye as series of fine rings extending around the circumference of a typical belt having a width of about 34 centimeters. The wave like topology of these ripples in the photoreceptor belt prevents uniform contact between a receiving sheet and toner images carried on the surface of the photoreceptor during toner image transfer and also adversely affects the quality of the final print. Ripples have also been observed to significantly reduce the efficiency of the cleaning blade function which in turn is detrimental to the creation of high quality images in the final print.

Anti-curl backing layers are usually employed on flexible photoreceptors to maintain a flat shape to photoreceptor. Photoreceptors with anti-curl backing layers exhibit less resistance to fatigue during cycling over machine belt support rollers. Fatigue leads to cracking of the charge transport layer as well as seam delamination and thereby shortening of the service life of the photoreceptor belt. Moreover, the presence of the anti-curl backing layer at the overlapped joint increases the volume of molten mass ejected during the ultrasonic seam welding process to form a large seam splash.

The application of an anti-curl backing layer coating during photoreceptor manufacturing represents an additional coating operation which increases the costs and complexity of manufacturing and decreases the photoreceptor production throughput. Since application of an anti-curl backing layer involves additional handling of a photoreceptor web, the extra handling increases the likelihood of creating more coating defects as well as introducing other physical and cosmetic defects such as scratches, creases, wrinkles and the like. Therefore, the application of an anti-curl backing layer leads to a substantial reduction in yield.

Although the foregoing was described in terms of an electrophotographic imaging belt, the problems described are equally applicable to electrographic imaging belts.

INFORMATION DISCLOSURE STATEMENT

U.S. Pat. No. 5,240,532 to Yu, issued Aug. 31, 1993—A process for treating a flexible electrostatographic imaging web is disclosed including providing a flexible base layer and a layer including a thermoplastic polymer matrix comprising forming at least a segment of the web into an arc having a radius of curvature between about 10 millimeters and about 25 millimeters measured along the inwardly facing exposed surface of the base layer, the arc having an imaginary axis which traverses the width of the web, heating at least the polymer matrix in the segment to at least the glass transition temperature of the polymer matrix, and cooling the imaging member to a temperature below the glass transition temperature of the polymer matrix while maintaining the segment of the web in the shape of the arc.

U.S. Pat. No. 5,021,109 to Petropoulos et al., issued Jun. 4, 1991—A process is disclosed for preparing a multilayered belt comprises heating a substrate formed of a polymeric material, the substrate having a predetermined inner circumference, to at least about the glass transition temperature of the polymeric material and then placing the sleeve on a cylindrical mandrel. The mandrel has an outer circumference slightly greater than the predetermined inner circumference of the seamless tube. The substrate on the mandrel is subsequently coated to form a multilayered composite belt. The composite belt is then heated to a temperature of at least about the glass transition temperature of the substrate and the composite structure is removed from one end of the mandrel. Removal of the composite belt from the mandrel may be facilitated by any suitable means such as small driven elastomeric rollers, vacuum cups, gravity with vacuum assist and the like. Upon cooling,. the composite structure has the predetermined inner circumference.

U.S. Pat. No. 4,840,873 to Kobayashi et al., issued Jun. 20, 1989—A process is disclosed for producing an optical recording medium, comprising heat treating an optical recording medium formed of a thin metal film on the minutely roughened surface of a plastic substrate, the medium being capable of strongly absorbing laser light of a specific wavelength region thereby being able to be written upon.

U.S. Pat. No. 4,532,166 to Thomsen et al., issued Jul. 30, 1985—A welded web is disclosed comprising a first edge of a web having at least one aperture overlapping a second edge of a web comprising thermoplastic material on an exposed surface along the second edge to form a region of contiguous contact between the first edge and the second edge, at least a portion of the thermoplastic material at least partially filling the aperture thereby bonding the first edge to the second edge. The web may be formed by a process comprising providing a web having a first edge, providing a web having a second edge, forming at least one aperture in at least the first edge, overlapping the first edge over the thermoplastic material on the exposed surface along the second edge whereby the thermoplastic material on the second edge at least covers the aperture to form a region of contiguous contact between the first edge and the second edge, raising the temperature at least in the region of contiguous contact adjacent the aperture whereby thermoplastic material from the second edge at least partially fills the aperture thereby bonding the first edge to the second edge.

U.S. Pat. No. 3,988,399 to Evans, issued Oct. 26, 1976—Described herein are articles which are heat recoverable in involute fashion to an overlapping, generally cylindrical configuration and which are useful as wrap-around sleeves for wires, cables, cable splices and the like. Also described are articles initially heat recoverable to an elongate S-shaped configuration, which latter can be wrapped about an elongate substrate, the edge portions thereof interlocked, and heat recovered to form a protective closure. The articles of the invention comprise a molecularly oriented unitary polymeric layer which has been differentially annealed while restrained against dimensional change and cross-linked to provide an anisotropic gradient from a first to a second primary face of the layer through the thickness thereof. Subsequently, when the article is heated to recovery temperature, regions of high anisotropy adjacent one primary face of the layer shrink. Because of the annealing process, regions adjacent the opposite primary face of the layer tend to resist linear shrinkage, whereupon the article heat recovers in involute fashion to form a wrap-around sleeve.

U.S. Pat. No. 4,961,089 to Jamzadeh, issued Oct. 2, 1990—Web tracking apparatus and methods are disclosed having particular utility in electrostatographic reproduction apparatus. A web includes a plurality of image frames allowing images to be written thereon and transferred therefrom to a receiver. A guide means moves such web along a path and includes a steering roller mounted for rotation about a caster axis and a gimbal axis. A web tracking system for controlling the guide means to effect lateral alignment of said web is provided such that the deviation of corresponding points of transferred images is minimized. Degradation of image registration due to mid-print corrections is eliminated and steering corrections are made less frequent by the use of adaptive and predictive algorithms. The writing and transfer of images is thereby accomplished in accurate registration and is particularly well-suited for use in forming accurate multicolor reproduction of superimposed images.

U.S. Pat. No. 5,078,263 to Thompson et al., issued Jan. 7, 1992—A web-steering mechanism is disclosed, particularly for the endless belt of a xerographic copier, uses two rolls to hold the belt under tension. An idler roll is designed to rotate about an axis which is at a small angle to a tilt axis of the idler roll assembly. Small tilting movements of the idler roll assembly, under the control of a servo-motor are effective to alter the angle at which the web enters and/or leaves the roll, to cause the web to walk along the tilted roll.

U.S. Pat. No. 4,174,171 to Hamaker et al., issued Nov. 13, 1979—An apparatus is disclosed in which the lateral alignment of a belt arranged to move in a pre-determined path is controlled. A support mounted resiliently constrains lateral movement of the belt causing the belt to apply a moment to a pivotably mounted steering post. As a result of this moment, the steering post pivots in a direction to restore the belt to the pre-determined path.

U.S. Pat. No. 4,344,693 to Hamaker, issued Aug. 17, 1982—An apparatus is disclosed which controls the lateral alignment of a belt arranged to move in a pre-determined path. A pivotably mounted belt support is frictionally driven to move in unison with the belt. Lateral movement of the belt applies a frictional force on the belt support. The frictional force tilts the belt support in a direction so as to restore the belt to the predetermined path of movement.

U.S. Pat. No. 4,061,222 to Rushing, issued Dec. 6, 1977—Apparatus is disclosed for automatically tracking an endless belt or web of material in a stable, predetermined path of movement despite changes in the belt configuration due to differential belt stretching or the introduction into the machine of a new belt having a slightly different configuration. The apparatus includes a steering roller supported for rotational movement about the longitudinal central axis and tilting movement about an axis perpendicular to the longitudinal axis. In one embodiment, a steering roller control signal is produced by comparing the magnitude of the weighted sum of voltage signals representative of the lateral belt edge position and the tilted roller position with the magnitude of the integrated sum of the lateral belt edge position signal and a command signal representative of the desired lateral belt edge position. In a second embodiment, the steering roller control signal is produced by comparing the magnitude of the weighted sum of voltage signals representative of the lateral belt edge position and the instantaneous lateral belt deviation rate with the magnitude of the command signal representative of the desired lateral belt edge position.

Thus, there is a continuing need for electrostatographic imaging belts having improved resistance to charge transport layer cracking, a thinner seam morphology, and suppressed belt ripples development.

SUMMARY OF THE INVENTION

It is, therefore, an object of the present invention to provide an improved electrostatographic imaging process which overcomes the above-noted deficiencies.

It is also an object of the present invention to provide a structurally simplified electrostatographic imaging member belt having robust mechanical life in imaging processes utilizing belt steering rolls.

It is still another object of the present invention to provide an improved electrostatographic imaging belt having an imaging layer which exhibits greater resistance to cracking during extensive imaging cycling.

It is still also an object of the present invention to provide an improved electrostatographic imaging belt having reduced seam thickness and small seam splash for cyclic imaging processes.

It is another object of the present invention to provide an improved electrostatographic imaging belt having a welded seam which exhibits greater resistance to delamination during extensive image cycling.

It is still yet another subject of the present invention to provide an improved electrostatographic imaging belt which resists ripple formation in imaging processes utilizing belt steering rolls.

It is yet another object of the present invention to provide an improved electrostatographic imaging belt which has longer cycling life in a liquid development imaging process.

The foregoing objects and others are accomplished in accordance with this invention by providing a stress free state in the imaging layer when the electrostatogaphic imaging belt flexes over small diameter support rollers.

It is also another object of the present invention to provide a method for structurally simplified electrostatographic imaging member fabrication.

The foregoing objects and others-are accomplished in accordance with this invention by providing an electrostatographic imaging process comprising providing a flexible electrostatographic, particularly electrophotographic, imaging belt comprising a substrate layer, a charge generating layer, charge transport layer, and two parallel longitudinal edges, the imaging belt having a charge transport layer tension strain of less than about 0.05 percent across the width of the belt, mounting the imaging belt on a plurality of spaced apart support rollers, transporting the belt around the support rollers, repeatedly applying a cross belt compression strain distributed in an arcuate gradient of increasing intensity from the longitudinal centerline of the belt to each of the edges of the belt, the strain applied at each of the edges of the belt repeatedly peaking to an intensity at the longitudinal edges of at least about 0.6 percent greater than the strain applied to the centerline of the belt, forming an electrostatic latent image on the belt, developing the electrostatic latent image with toner to form a toner image corresponding to the latent image, transferring the toner image to a receiving member, and repeating the forming, developing and transferring steps at least once. The flexible electrostatographic imaging belt may be fabricated without an anti-curl layer in a continuous process.

Electrostatographic flexible belt imaging members are well known in the art. Typically, a flexible substrate is provided having an electrically conductive surface to anchor all the applied coating layers. For electrophotographic imaging members, at least one photoconductive layer is then applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto an adhesive layer, if present, or directly over the blocking layer, and a charge transport layer is subsequently formed on the charge generation layer. For ionographic imaging members, an electrically insulating dielectric imaging layer is applied to the electrically conductive surface. The substrate may carry an optional anti-curl back coating on the side opposite from the side bearing the charge transport layer or dielectric imaging layer to flatten the imaging member.

For reasons of convenience, the following discussion of electrostatographic imaging members will be represented by reference to only electrophotographic imaging members. However, it should be understood that much of the following discussion applies equally to electrographic imaging members.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, polysulfones, and the like which are flexible as thin webs. The electrically insulating or conductive substrate should be flexible and in the form of an endless flexible belt. Preferably, the endless flexible belt shaped substrate comprises a commercially available biaxially oriented polyester known as Mylar, available from E. I. du Pont de Nemours & Co. or Melinex available from ICI Americas, Inc. or Hostaphan, available from American Hoechst Corporation.

The thickness of the substrate layer depends on numerous factors, including beam strength and economical considerations, and thus this layer for a flexible belt may be of substantial thickness, for example, about 175 micrometers, or of minimum thickness less than 50 micrometers, provided there are no adverse effects on the final electrostatographic device. In one flexible belt embodiment, the thickness of this layer is between about 65 micrometers and about 150 micrometers, and preferably between about 75 micrometers and about 100 micrometers for optimum flexibility and minimum stretch when cycled around small diameter rollers, e.g. 19 millimeter diameter rollers.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a transparent copper iodide (CuI) or a conductive carbon black dispersed in a plastic binder as an opaque conductive layer. A typical electrical conductivity for conductive layers for electrophotographic imaging members in slow speed copiers is about 102 to 103 ohms/square.

After formation of an electrically conductive surface, a charge blocking layer may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds as disclosed, for example, in U.S. Pat. Nos. 4,291,110, 4,338,387, 4,286,033 and 4,291,110, the disclosures of these patents being incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters such as dupont 49,000 (available from E. I. dupont de Nemours and Company) and Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer. Typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal free phthalocyanine, metal phthalocyanines such as vanadyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure thereof being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises between about 25 percent and about 75 percent by weight of at least one charge transporting aromatic amine compound, and between about 75 percent and about 25 percent by weight of a polymeric film forming resin in which the aromatic amine is soluble.

The charge transport layer forming mixture preferably comprises an aromatic amine compound. Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4"-bis(diethylamino)-2',2"-dimethyltriphenylmethane, N,N'-bis-(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive thermoplastic resin binder soluble in methylene chloride or other suitable solvent may be employed in the process of this invention to form the thermoplastic polymer matrix of the imaging member. Typical inactive resin binders include polycarbonate resin, polyvinylcarbazole, polyester, polyarylate, polyacrylate, polyether, polysulfone, polystyrene, and the like. Molecular weights can vary from about 20,000 to about 150,000.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins have a molecular weight from about 20,000 to about 150,000, more preferably from about 50,000 to about 120,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabriclcen Bayer A. G. and a polycarbonate resin having a molecular weight of from about 20,000 to about 50,000 available as Merlon from Mobay Chemical Company.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

If desired, a charge transport layer may comprise electrically active resin materials instead of or mixtures of inactive resin materials with activating compounds. Electrically active resin materials are well known in the art. Typical electrically active resin materials include, for example, polymeric arylamine compounds and related polymers described in U.S. Pat. No. 4,801,517, U.S. Pat. No. 4,806,444, U.S. Pat. No. 4,818,650, U.S. Pat. No. 4,806,443 and U.S. Pat. No. 5,030,532 and polyvinylcarbazole and derivatives of Lewis acids described in U.S. Pat. No. 4,302,521. Electrically active polymers also include polysilylenes such as poly(methylphenyl silylene), poly(methylphenyl silylene-co-dimethyl silylene), poly(cyclohexylmethyl silylene), poly(tertiary-butylmethyl silylene), poly(phenylethyl silylene), poly(n-propylmethyl silylene), poly(p-tolylmethyl silylene), poly(cyclotrimethylene silylene), poly(cyclotetramethylene silylene), poly(cyclopentamethylene silylene), poly(di-t-butyl silylene-co-di-methyl silylene), poly(diphenyl silylene-co-phenylmethyl silylene), poly(cyanoethylmethyl silylene) and the like. Vinyl-aromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Other polymeric transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as Described in U.S. Pat. No. 3,870,516. The disclosures of each of the patents identified above pertaining to binders having charge transport capabilities are incorporated herein by reference in their entirety.

Other layers such as conventional electrically conductive ground strip along one edge of the belt in contact with the conductive layer, blocking layer, adhesive layer or charge generating layer to facilitate connection of the electrically conductive layer of the photoreceptor to ground or to an electrical bias. Ground strips are well known and comprise usually comprise conductive particles dispersed in a film forming binder.

For electrographic imaging members, a flexible dielectric layer overlying the conductive layer may be substituted for the active photoconductive layers. Any suitable, conventional, flexible, electrically insulating, thermoplastic dielectric polymer matrix material may be used in the dielectric layer of the electrographic imaging member. If desired, the flexible belts of this invention may be used for other purposes where cycling durability is important.

The foregoing objects and others are accomplished in accordance with this invention by providing a process to fabricate a flexible electrostatographic imaging member web comprising a flexible support substrate, at least one coating layer comprising a film forming thermoplastic polymer, and without the need of an anti-curl backing layer. The process employed to achieve the purpose of fabricating electrostatographic imaging member without the need of an anti-curl backing layer involves one added step of guiding an imaging member web, after charge transport layer production creating followed by subsequent elevated temperature drying and emerging from the dryer, directly 180? over a chill roll having a diameter of between about 0.75 inch and about 1 inch, with the substrate support of the imaging web intimately contacting the chill roll while the charge transport layer facing outwardly, to effect quenching of the imaging member web and yield the desired imaging member conformed, in the web direction to the curvature of the chill roll. When cut into a rectangular sheet of predetermined dimensions and ultrasonically welded into a seam of imaging member belt, no imaging belt edge curling is detectable.

An anti-curl backing layer is usually employed to flatten the shape of a flexible photoreceptor. This anti-curl backing layer increases the overall thickness of the resulting photoreceptor device by about 20 percent. It has been found that an increase in photoreceptor thickness increases the induced bending stress of the photoreceptor when flexed over machine belt support rollers. The increase in bending stress coupled with internal stress which already exists in the charge transport layer can significantly reduce the resistance of the charge transport layer to fatigue and cracking during image cycling thereby shortening service life of the photoreceptor belt. Moreover, the presence of an anti-curl backing layer at the overlapped joint leads to an increase in the volume of the molten mass which is ejected from the overlapped joint to form an excessively large seam splash during the ultrasonic seam welding process.

The process of this invention includes treating the flexible electrophotographic imaging web to achieve charge transport layer stress release as well as eliminating the need for an anti-curl backing layer as described above and hereinbelow. The process comprises permanent bending conformance of the entire imaging member web, with the charge transport layer facing outwardly, in an arc having an imaginary axis which traverses the width of the web. The arc axis is substantially perpendicular to the longitudinal direction of the long edges of the web. In other words, the arc is visible when viewing the edge of the web in a direction perpendicular to the longitudinal direction of the long edges of the web.

After the treatment process, the imaging member web should assume an arc shape, in the unrestrained free state, having a radius of curvature preferably between about 0.3 inch (0.76 cm) and about 0.6 inch (1.52 cm) measured from an imaginary center axis to the exposed surface of the substrate layer in order to fully realize the benefits offered by the present invention. When the radius of curvature is less than about 0.3 inch (0.76 cm), a seamed imaging member belt of this invention will exhibit downward (away from the charge transport layer) edge curling. However, when the radius of curvature is greater than about 0.6 inch (1.52 cm) a seamed imaging member belt of this invention will show upward edge curling (toward the charge transport layer). Although a true arc in the imaging member web is particularly preferred, the arc, need not be perfectly true, i.e. it does not have to fully coincide with all parts of the ring of a true circle. In other words, a slight variance from a perfectly circular arc is acceptable as long as the shape is a substantially smooth arc incrementally made up of a series of arcs having progressively increasing or decreasing radii of curvature, provided that all arcs have a radii length within the range limit of from about 0.3 inch (0.76 cm) to about 0.6 inch (1.52 cm) in order to fully eliminate imaging member web edge curling. The arc should have a substantially smooth transition in radius of curvatures to avoid abrupt changes in shape along the curve of the arc. Any segment of an arc having a shape that is a radical departure from a radius of curvature in the range from about 0.3 inch (0.76 cm) to about 0.6 inch (1.52 cm) can result in the formation of a bump or hump that does not fully conform to the surface of support rollers or is visible in straight runs between support rollers thereby adversely affecting imaging performance during charging, exposure, development, transfer, cleaning and/or erase operations.

Welded seamed electrophotographic imaging belts are well know in the art. In a typical welded seamed belt, the seam is prepared by overlapping opposite ends of a rectangular or square web for a distance of between about 0.5 mm and about 1.5 mm and welding the overlapped ends together by conventional techniques such as by contact with an ultrasonic welding horn. Seams fabricated with this method using the prior art electrophotographic imaging members have an excessive seam overlap thickness and large splashings which interfere with cleaning blade operations, exacerbate cleaning blade wear and tear, affect belt motion, and disturb toner image acoustic transfer assist device operations. This type of imaging belt is also prone to develop charge transport layer cracking and belt ripples when fatigue cycled in an imaging machine.

For a seamed imaging belt prepared with an imaging member web having no anti-curl backing layer, the thickness of the welded seam is substantially reduced and the size of the seam splash is cut by half. As a consequence, the reduced seam thickness with smaller seam splash minimizes seam delamination failure when flexed over a small diameter roller. Furthermore, a thinner electrophotographic imaging member configuration coupled with charge transport layer stress release through the process of the present invention extends imaging member fatigue cycling life over small diameter belt support rollers without encountering charge transport cracking or liquid developer exposure induced cracking of bent imaging members.

BRIEF DESCRIPTION OF THE DRAWINGS

The figures are merely schematic illustrations of the prior art and the present invention. They are not intended to indicate relative size and dimensions of actual seamed electrophotographic imaging members.

A more complete understanding of the structured configuration of flexible electrophotographic imaging belts of the present invention and its impact on improving the mechanical function life can be described by reference to the accompanying drawings wherein.

Figure 1:
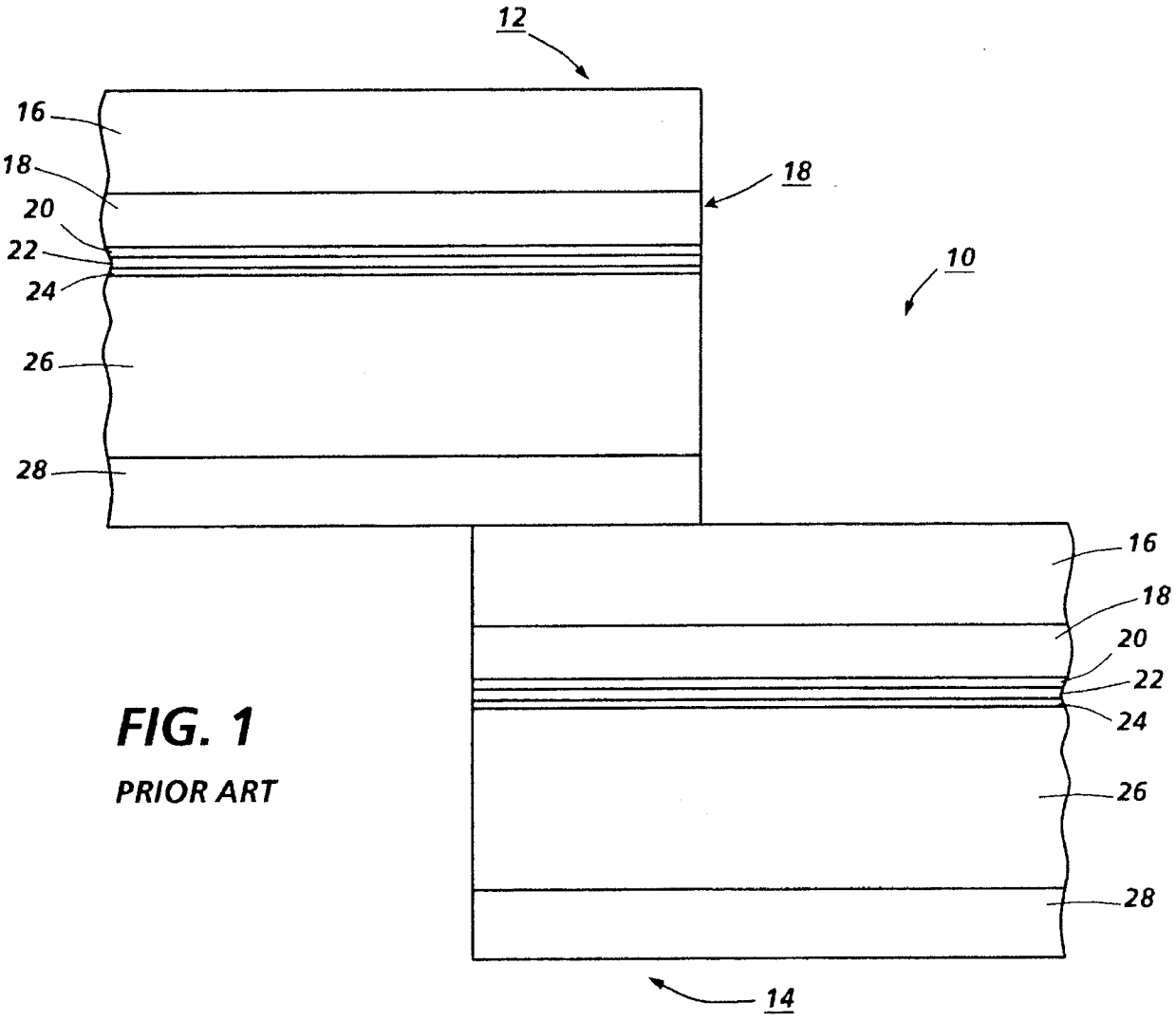
FIG. 1 PRIOR ART
FIG. 1 is a cross sectional view of a flexible multiple layered electrophotographic imaging member showing overlapped opposite ends of a sheet.

The fabrication of seamed imaging member layers using the conventional electrophotographic imaging member configurations in comparison to the structurally simplified imaging member counterpart of the present invention are described in detail below:

Referring to FIG. 1, a flexible electrophotographic imaging member 10 in the form of a rectangular sheet is illustrated having a first edge 12 overlapping a second edge 14 to form an overlap region, as known in the art. Satisfactory overlap widths range from about 0.5 millimeter to about 1.7 millimeters. The flexible electrophotographic imaging member 10 can be utilized in an electrophotographic imaging apparatus and may be a single layer or the illustrated multiple layer type photoreceptor. The layers of the flexible imaging member 10 can comprise numerous suitable materials having the required mechanical properties. These layers usually comprise charge transport layer 16, charge generating layer 18, adhesive layer 20, charge blocking layer 22, electrically conductive layer 24, supporting substrate 26 and anti-curl backing layer 28. Examples of the types of layers and the properties thereof are described, for example, in U.S. Pat. No. 4,786,570, U.S. Pat. No. 4,937,117 and U.S. Pat. No. 5,021,309, the disclosures thereof being incorporated herein by reference in their entirety. If desired, the flexible imaging member 10 may comprise a charge transport layer sandwiched between a conductive surface and a charge generator layer (not shown).

Figure 2:
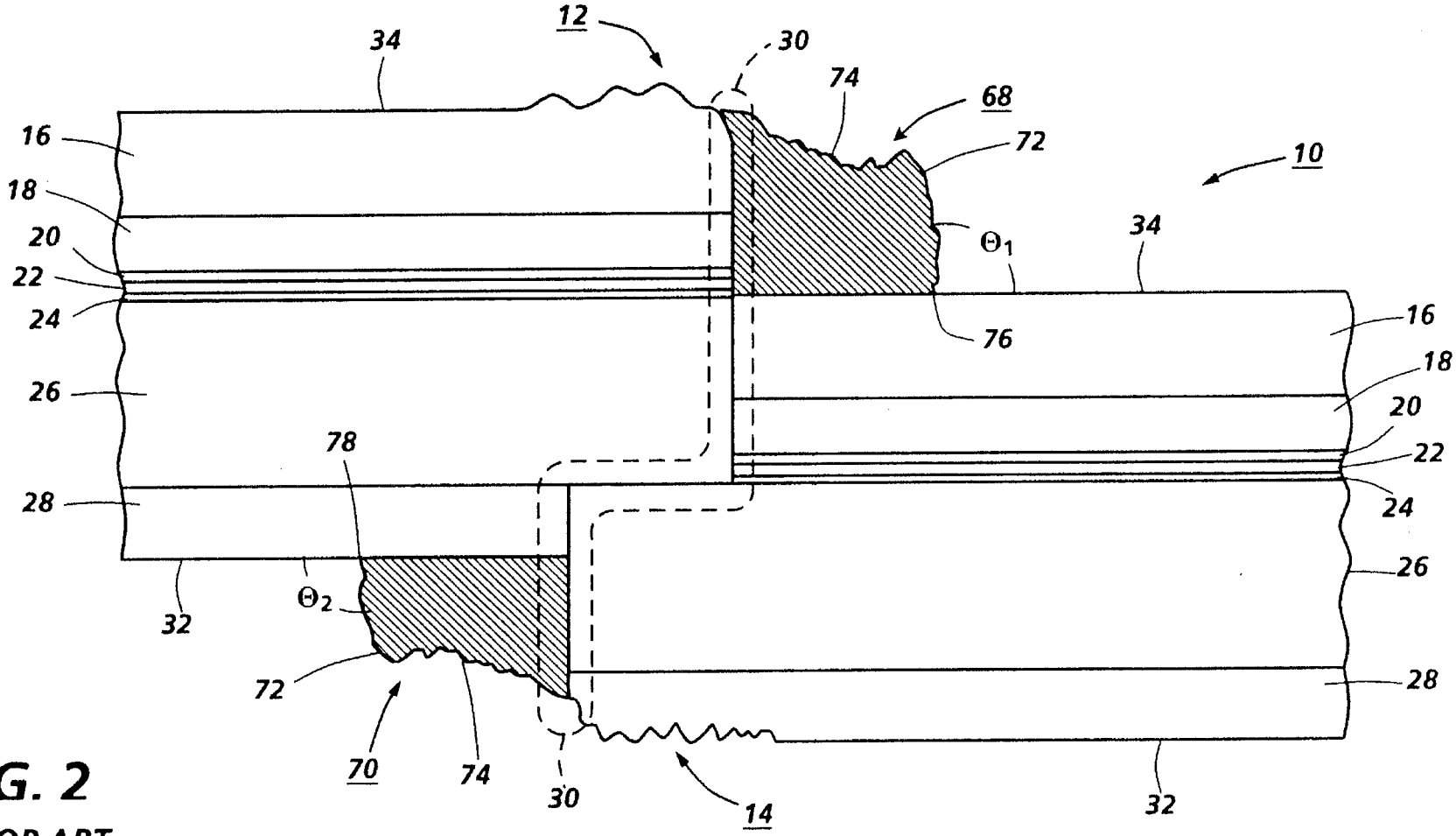
FIG. 2 PRIOR ART
FIG. 2 is a cross sectional view of the flexible multiple layered electrophotographic imaging member ends of FIG. 1 joined by an ultrasonic welding technique.

Edges 12 and 14 can be joined by any suitable means. Typical joining techniques include, for example, gluing, taping, stapling, pressure and heat fusing to form a continuous member, such as a belt, sleeve, or cylinder. Generally, an ultrasonic welding technique is preferred to bond edges 12 and 14 into a seam 30 in the overlap region as illustrated in FIG. 2. In the ultrasonic seam welding process, ultrasonic energy is applied to the overlap region to melt the applicable layers of flexible imaging member 10 such as charge transport layer 16, charge generating layer 18, adhesive layer 20, charge blocking layer 22, a part of supporting substrate 26, and anti-curl backing layer. Flexible imaging member 10 is thus transformed from an electrophotographic imaging member sheet as illustrated in FIG. 1 into a continuous seamed electrophotographic imaging belt as shown in FIG. 2. Seam 30 (represented by dashed lines) joins opposite ends of flexible imaging member 10 such that the second major exterior surface 34 (and generally including at least one layer thereabove) at and/or near the first edge 12 is integrally joined with the first major exterior surface 32 (and generally at least one layer therebelow) at and/or near second edge 14. Welded seam 30 contains upper and lower splashings 68 and 70 at ends 12 and 14, respectively, as illustrated in FIG. 2. Splashings 68 and 70 are formed during the process of joining edges 12 and 14 together. Molten material is necessarily ejected from the overlap region to facilitate direct fusing of support substrate 26 (of first edge 12) to support substrate 26 (of second edge 14). This results in the formation of splashings 68 and 70. Upper splashing 68 is formed and positioned above the overlapping second edge 14 abutting second major exterior surface 34 and adjacent and abutting overlapping first edge 12. Lower splashing 70 is formed and positioned below the overlapping first edge 12 abutting first major exterior surface 32 and adjacent and abutting the overlapping second edge 14. Splashings 68 and 70 extend beyond the sides and the ends of seam 30 in the overlap region of welded flexible member 10. The extension of the splashings 68 and 70 beyond the sides and the ends of the seam 30 is undesirable for many machines, such as electrostatographic copiers and duplicators which require precise belt edge positioning of flexible imaging member 10 during machine operation. Generally, the protrusions of the splashings 68 and 70 (or flashings) extending beyond each end (not shown) of the seam usually are removed by a notching operation which cuts a slight notch into each end of the seam to remove the end splashings and a tiny portion of the seam itself.

A typical splashing has a thickness of about 68 micrometers. Each of the splashings 68 and 70 have an uneven but generally rectangular shape having a free side 72 and an exterior facing side 74. Exterior facing side is generally parallel to either second major exterior surface 34 or first exterior major surface 32. Free side 72 of splashing 68 is almost perpendicular to first major exterior surface 32 at junction 76 and free side 72 of splashing 70 is almost perpendicular with the second major exterior surface 34 at junction 78. Both junctions 76 and 78 provide focal points for stress concentration and become the initial sites of failure affecting the mechanical integrity of flexible imaging member 10.

During imaging machine operation, the flexible imaging member 10 cycles or bends over belt support rollers, not shown, particularly small diameter rollers, of an electrophotographic imaging apparatus. As a result of dynamic bending of flexible imaging member 10 during cycling, the small diameter rollers exert a bending strain on flexible imaging member 10 which causes large stress to develop generally around seam 30 due to the excessive thickness thereof. The stress concentrations that are induced by bending near the junction sites 76 and 78 may reach values much larger than the average value of the stress over the entire belt length of flexible imaging member 10. The induced bending stress is inversely related to the diameter of the roller over which flexible imaging member 10 bends and directly related to the thickness of seam 30 of flexible imaging member 10. When the thickness of overlap region of flexible imaging member 10 is enlarged, high localized stress occurs near the regions of discontinuity, e.g. junction points 76 and 78. When flexible imaging member 10 is bent over belt support rollers in an electrophotographic imaging apparatus (not shown), first major exterior surface 32 of flexible member 10, in contact with the exterior surface of the roller, is under compression. In contrast, second major exterior surface 34 is stretched under tension. This is attributable to the fact that first major exterior surface 32 and second major exterior major surface 34 move through part of an arcuate path about a roller having a circular cross section. Since second major exterior surface 34 is located at a greater radial distance from the center of the roller than first exterior major surface 32, second major exterior surface 34 must travel a greater distance than first major exterior surface 32 in the same time period. Therefore, second major exterior surface 34 is stretched under tension relative to the generally central portion of the flexible imaging member 10 (the portion generally extending along the center of gravity of flexible imaging member 10). Conversely, first major exterior surface 32 is compressed relative to the generally central portion of flexible imaging member 10. Consequently, the bending stress at junction 76 will be tension stress, and the bending stress at junction 78 will be compression stress.

Figure 3:
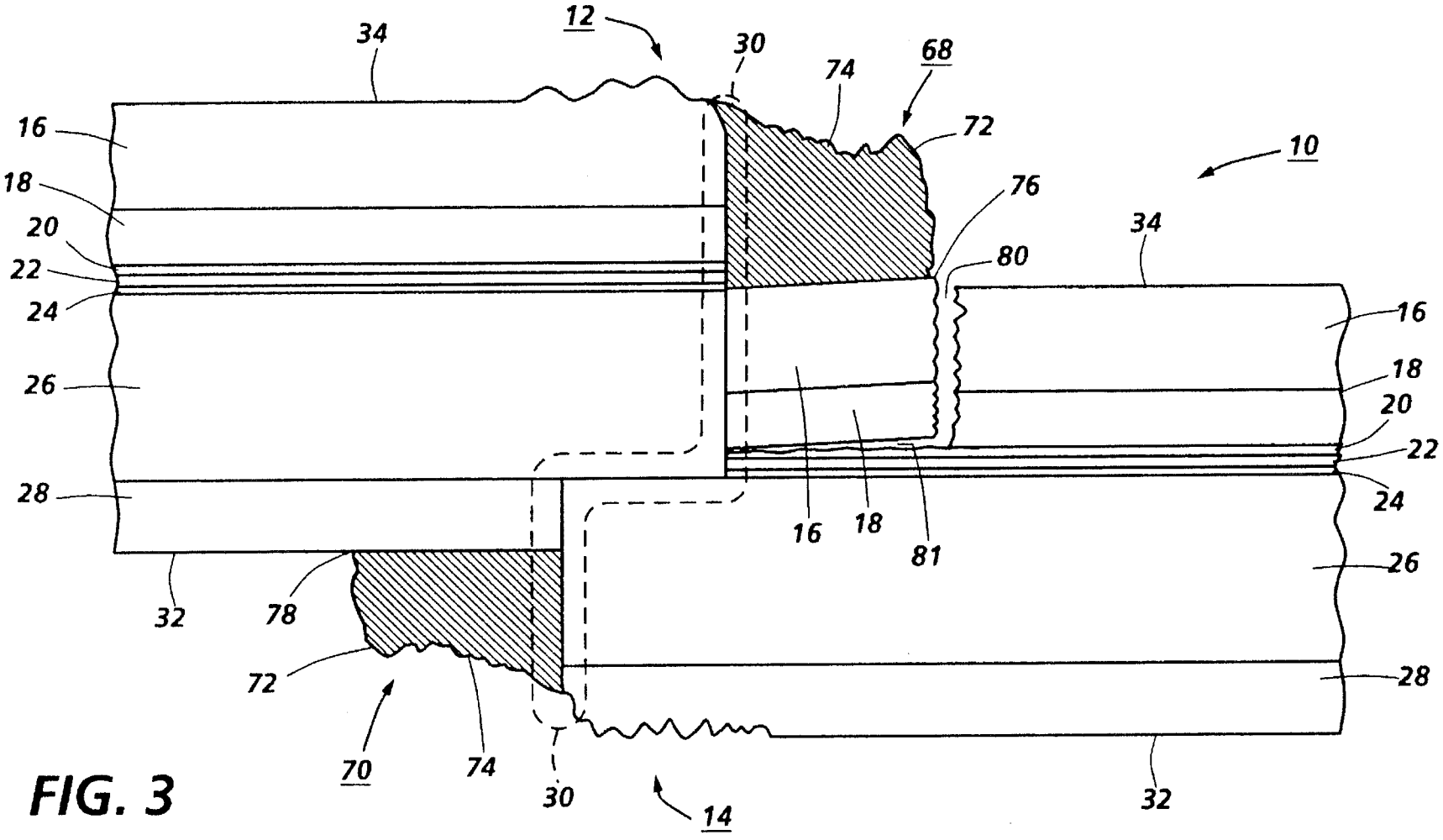
FIG. 3 PRIOR ART
FIG. 3 is a cross sectional view of the flexible multiple layered seamed electrophotographic imaging belt of FIG. 2 exhibiting seam cracking and delamination after flexing over belt support rollers.

Compression stresses, such as at junction 78, rarely cause seam 30 failure. Tension stresses, such as at junction 76, however, are much more serious. The tension stress concentration at junction 76 greatly increases the likelihood of tear initiation which will form a crack through the electrically active layers of flexible imaging member 10 as illustrated in FIG. 3. Tear 80, illustrated in FIG. 3, is adjacent second edge 14 of the flexible imaging member 10. The tear 80 is initiated in charge transport layer 16 and propagates through charge generating layer 18 along a plane that extends from the surface of free side 72. Inevitably, tear 80 extends generally horizontally leading to seam delamination 81 which propagates along the interface between the adjoining surfaces of the relatively weakly adhesively bonded charge generating layer 18 and adhesive layer 20. Because of its appearance, localized seam delamination 81 is typically referred to as "seam puffing". The excessive thickness of splashing 68 and stress concentration at junction site 76 tend to promote the development of dynamic fatigue failure of seam 30 and can lead to separation of the joined edges 12 and 14 and severing of flexible imaging member 10. This greatly shortens the service life of flexible imaging member 10.

In addition to causing seam failure, tear 80 acts as a depository site which collects toner particles, paper fibers, dirt, debris and other undesirable materials during electrophotographic imaging and cleaning. For example, during the cleaning process, a conventional cleaning instrument (not shown), such as a cleaning blade, will repeatedly pass over tear 80. As the site of tear 80 becomes filled with debris, the cleaning instrument dislodges at least a portion of highly concentrated debris from tear 80. The amount of the dislodged debris, however, is often beyond the capability of the cleaning instrument to remove from imaging member 10. As a consequence, the cleaning instrument will dislodge the highly concentrated level of debris, but will not be able to remove the entire amount during the cleaning process. Therefore, portions of the highly concentrated debris will be deposited onto the surface of flexible imaging member 10. In effect, the cleaning instrument spreads the debris across the surface of flexible imaging member 10 rather than effectively removing the debris therefrom.

Besides leading to seam failure and debris spreading, when local seam delamination 81 occurs, the portion of flexible imaging member 10 above seam delamination 81, in effect, becomes a flap which can move upwardly. The upward movement of the flap presents an additional problem in the cleaning operation because it is an obstacle in the path of the cleaning instrument as the instrument travels across the surface of flexible imaging member 10. The cleaning instrument eventually strikes the flap when the flap extends upwardly. As the cleaning instrument strikes the flap, great force is exerted on the cleaning instrument and can lead to cleaning blade damage, e.g. excessive wear and tearing of a blade.

In addition to damaging the cleaning blade, collisions with the flap by the blade causes unwanted velocity variations in flexible member 10 during cycling. This unwanted velocity variation adversely affects the copy/print quality produced by the flexible imaging member 10, particularly in high speed precision machines such as in color copiers where colored toner images must be sequentially deposited in precisely registered locations. More specifically, copy/print quality is adversely affected because imaging takes place on one part of flexible imaging member 10 simultaneously while the cleaning blade collides with the flap while cleaning another part of flexible imaging member 10.

The velocity variation problems encountered with flexible imaging member 10 are not exclusively limited to flexible imaging member 10 undergoing seam delamination 81. The discontinuity in cross-sectional thickness of the flexible imaging member 10 at junction sites 76 and 78 also can create unwanted velocity variations, particularly when flexible imaging member 10 bends over small diameter rollers of a belt module or between two closely adjacent rollers. Moreover, splashing 70 underneath the seam can collide with acoustic image transfer assist subsystems (not shown) during dynamic belt cycling, thereby causing additional unacceptable imaging belt velocity disturbances.

Figure 4:
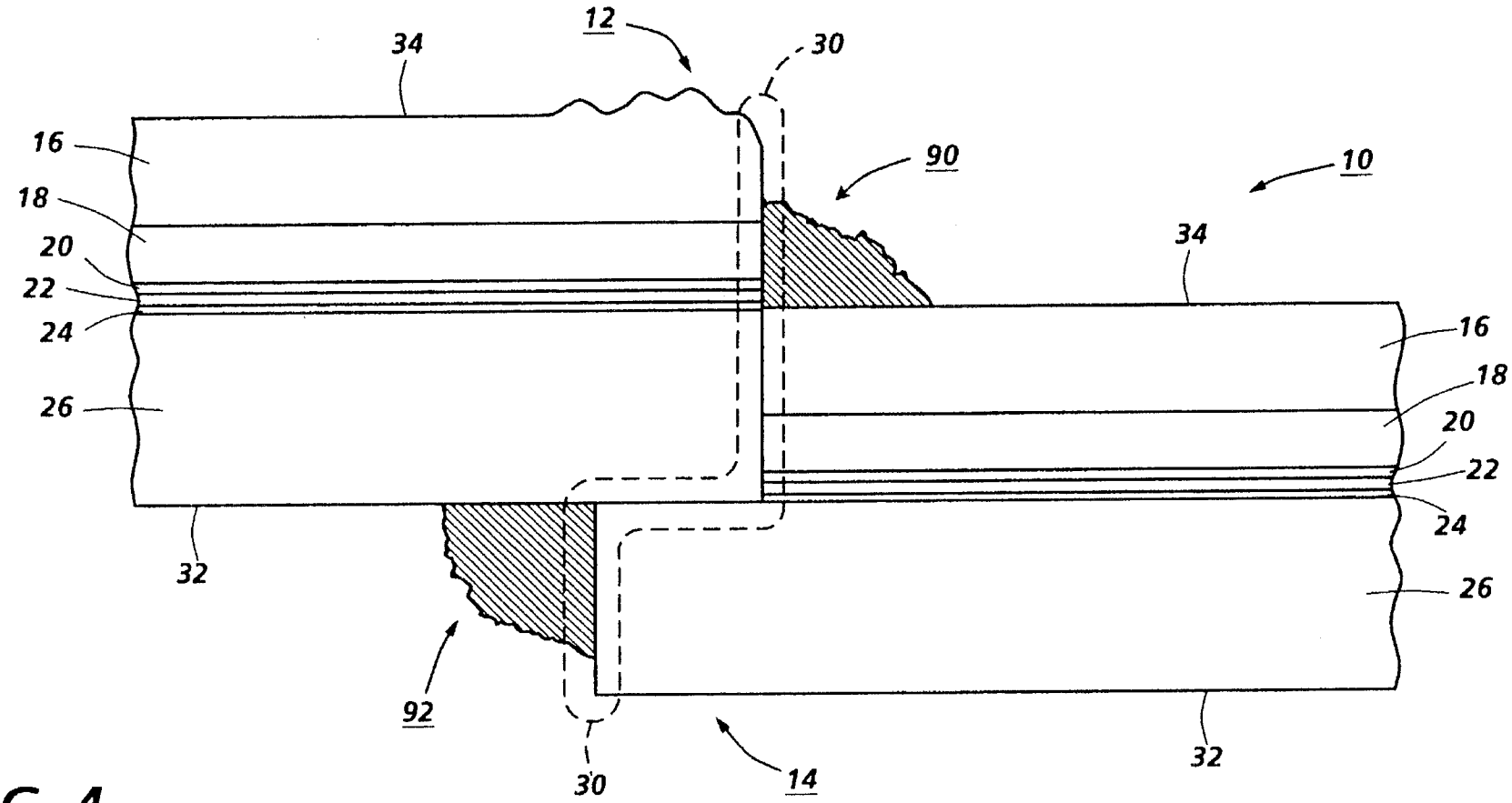
FIG. 4 is a cross sectional view of a structurally simplified ultrasonically welded electrophotographic imaging member seam having a stress released charge transport layer and no anti-curl backing layer.

In FIG. 4, an ultrasonically welded seam prepared by a process of the present invention is shown. In comparison to the prior art electrophotographic imaging member welded seams illustrated in FIGS. 2 through 3, the seam configuration employed in the process of this invention has a reduced seam overlap thickness and smaller seam splashes 90 and 92. This imaging member is also free of any anti-curl backing layer such as the anti-curl backing layer 28 shown in FIGS. 1 through 3. Furthermore, the seam configuration of an imaging member of the present invention is also found to yield a slightly higher seam rupture strength than the prior art seam, since the seam formed, using an imaging member free of an anti-curl backing layer has one less layer to melt, will provide effective overlap fusing during ultrasonic seam welding process. When fatigue flexed over a small 3 mm diameter roller, a prior art seam develops seam delamination after only 8 flexes while seam failure for the seam of the anti-curl layer free imaging member is not observed until after 35 flexes of testing. In another embodiment, dynamic cycling of an anti-curl layer free seamed electrophotographic imaging member belt of the present invention carried out in a belt supporting module employing an active steering/tension roll for belt with control does not develop ripples in up to 30,000 cycles of testing. In sharp contrast, a seamed prior art electrophotographic imaging member belt tested in the same belt support module exhibits the onset of belt ripples in only 180 cycles.

Thus, an electrophotographic imaging member free of an anti-curl backing layer prepared by the continuous process of this invention is free of stress in the charge transport layer when the imaging belt is bent in an arc and passed around chilled small belt support rollers ranging in diameter from about 0.6 inch to about 1 inch. Electrophotographic imaging members free of stress in the charge transport layer are especially desirable in systems utilizing belt steering rollers.

Figure 5:
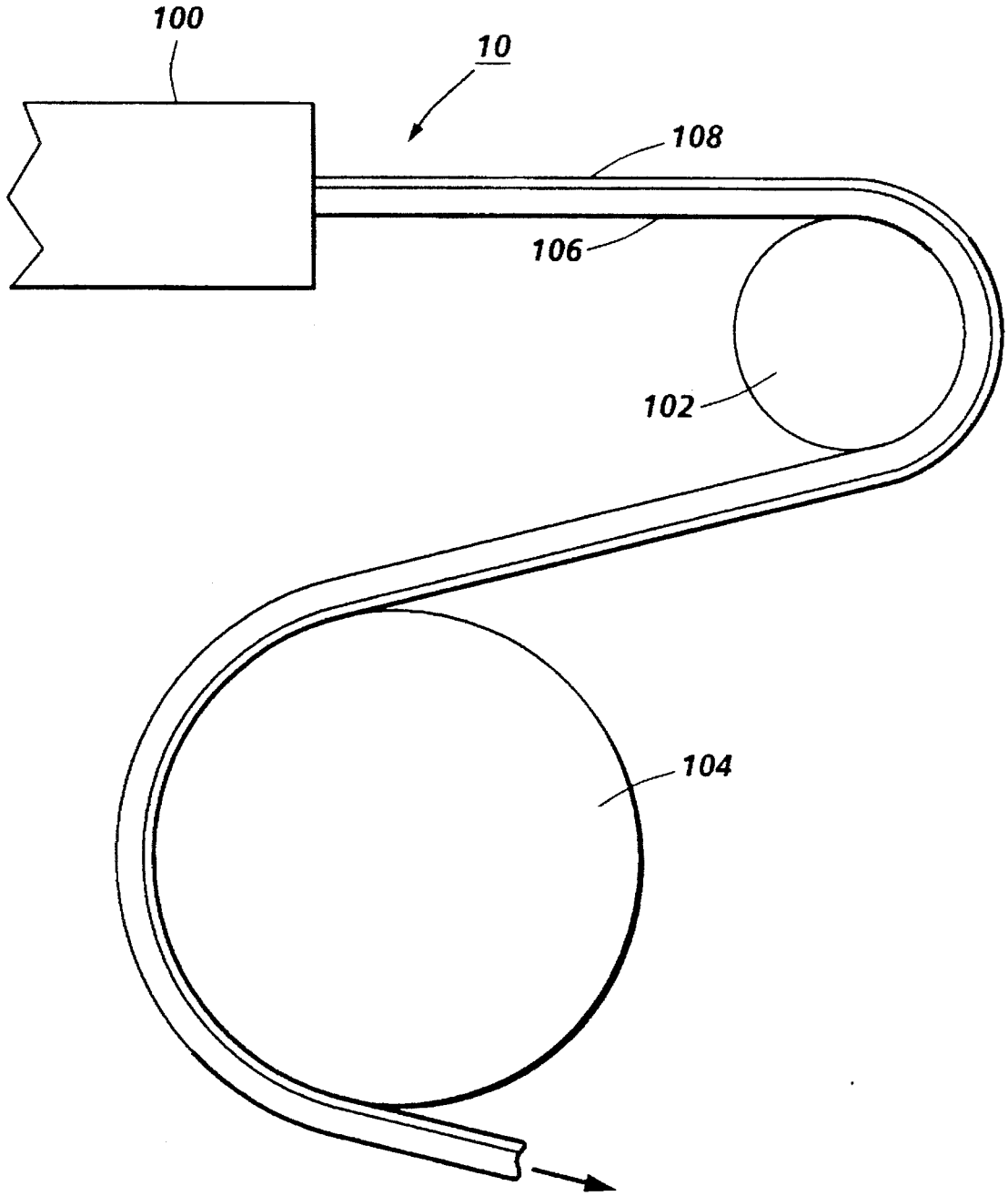
FIG. 5 is a schematic illustration showing a charge transport layer heat stress release continuous process of the present invention in which an electrophotographic imaging member web emerging from a drying oven, at elevated temperature, is quenched to room ambient temperature while the substrate layer contacts a chill roll.

FIG. 5 shows an imaging member 10 emerging from a conventional charge transport layer oven dryer 100. Imaging member 10 is at an elevated temperature of at least about 100° C. as it leaves dryer 100 and is transported through an arc of about 180° around a chill roll 102 having a diameter of between about 0.6 inch and about 1.2 inches. During the time period of contact between the imaging member 10 and chill roll 102, the temperature of imaging member 10 is immediately quenched down to ambient room temperature. In other words, imaging member 10 is at ambient room temperature by the time it leaves the chill roll 102. Imaging member 10 is subsequently passed over a large transport roll 104 and sent to a conventional wind-up roll (not shown). As a matter of convenience, the electrophotographic imaging member web 10 is represented in FIG. 4 by a substrate support layer 106 and a single composite layer 108 containing a charge transport layer, charge generating layer, adhesive layer, hole blocking layer, and the thin ground plane. The effect on the imaging member web 10, as it passes over the chill roll 102, can be determined by employing the second order differential equation to describe the unsteady state of condition, heat transfer through the thickness of the web below:

$$\alpha \frac{\partial^2 \theta}{\partial x^2} = \frac{\partial \theta}{\partial t} \quad [1]$$

The solution for equation [1] yields:

$$\theta_f = \theta_o + (\theta_c - \theta_o) erfc\ (x/2\sqrt{at}) \quad (2)$$

but $$\alpha = k/lC_p \quad (3)$$

wherein:

k is the heat conductivity of the web, l is the density of the web, $C_p$ is the heat capacity of the web, $\theta_c$ is the temperature of the chill roll, $\theta_o$ is the temperature of the web immediately prior to contact with the chill roll, $\theta_f$ is the temperature of the web leaving the chill roll after the time period of web/chill roll contact, and x is the thickness of the web.

The following are specific boundary conditions of the process for a specific run:

$k=3.55\times10^{-4}$ cal/cm sec°C.

$l=1.35$ gms/cm$^3$ $C_p=0.32$ cal/gm°C.

$\theta_o=100°$ C.

t=0.1122 sec., based on web transport speed of 70 ft./min., chill roll having a diameter of 1 inch, and a 180° web wrap around arc.

x=100 micrometers or 0.01 cm.

Substituting these values in equations [3] and [2] above, an expression relating the web temperature to the temperature of the chill roll is obtained and shown below:

$$\theta_f = 0.4621\theta_c + 53.7899$$

Thus, for example, the target chill roll temperature $\theta_c$ may be readily determined using the equations above to achieve the desired temperature for the web leaving the chill roll after the time period t of web/chill roll contact. Chill roll temperature is controlled by conventional means such as the regulation of coolant feed rates to the chill roll. Typical coolants include, for example, water, super cooled water with dissolved anti freeze, liquid nitrogen and the like.

When cut into a rectangular sheet of predetermined dimensions and ultrasonically welded into a seam of imaging member belt, no imaging belt edge curling is detectable in the belts formed by this continuous photoreceptor web fabrication process. The fabricated webs of this invention have a charge transport layer tension strain of less than about 0.05 percent across the width of the web in the free unconstrained state.

Figure 6:
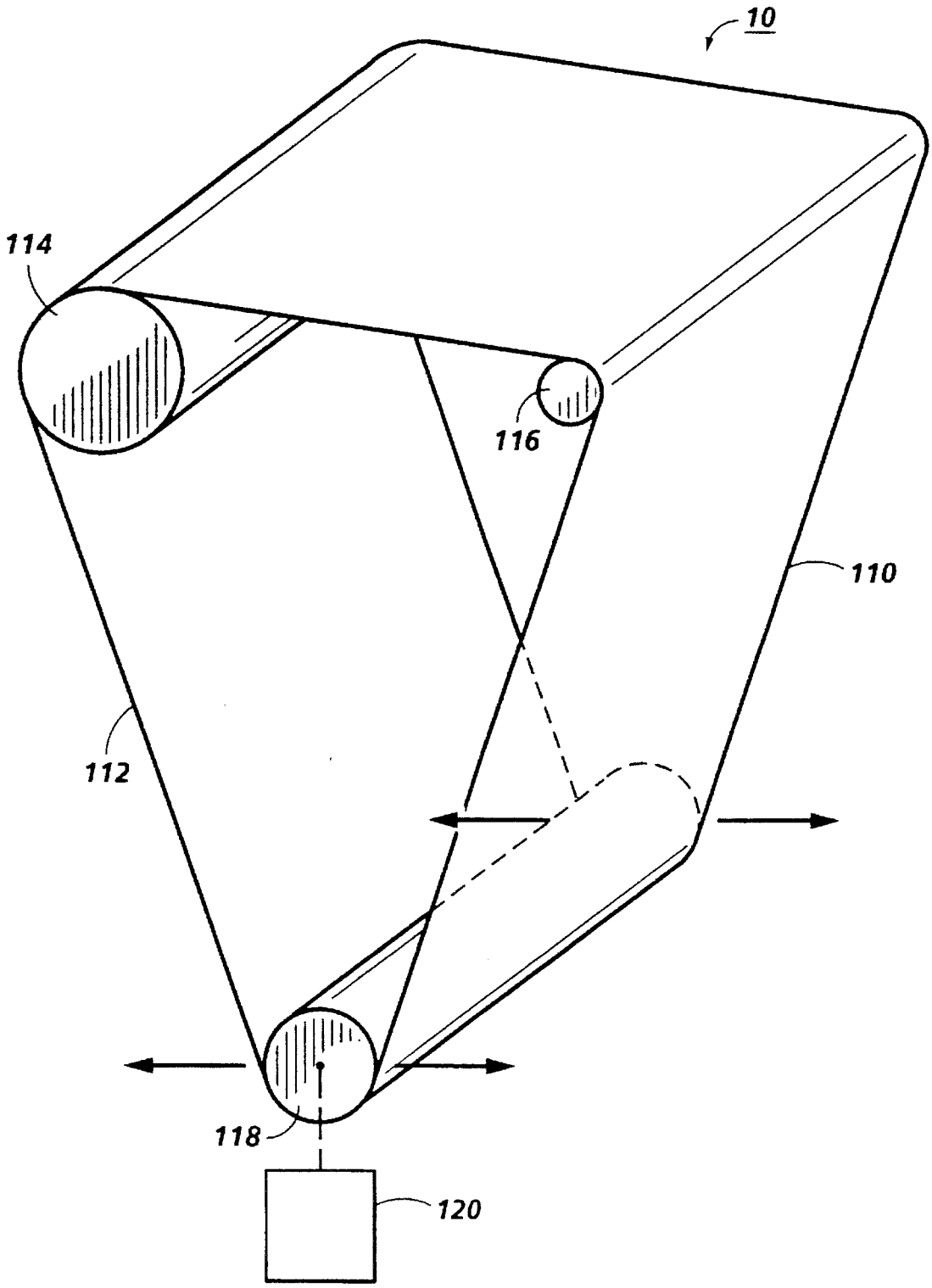
FIG. 6 is a cross sectional view of a structurally simplified electrophotographic imaging member belt of FIG. 4 under dynamic cyclic operating conditions of a belt support module employing an active steering and tension applying roller to control belt walk.

Shown in FIG. 6 is a conventional electrophotographic imaging belt imaging support system utilized in electrophotgraphic imaging machines. A flexible electrostatographic imaging belt 10 having two parallel longitudinal edges 110 and 112 is mounted on support rollers 114 and 116 and a center pivoted belt steering and tension applying roller 118. The rollers 114, 116 and 118 are substantially parallel to and spaced from each other. Generally, the largest support roller, i.e. 114, also functions as a drive-roller to drive the belt. The drive-roller is driven by a conventional means such as an electric motor direct drive, gear drive or belt drive to transport belt 10 around rollers 114, 116 and 118. The belt 10 is maintained in a predetermined position on support rollers 114 and 116 relative to the ends of rollers 114 and 116 by conventional steering and tension applying roller 118 which guides the belt 10 by tilting of the axis of roller 118 in the direction shown by the arrows in response to a conventional detector and controller 120. Periodic tilting of belt steering and tension applying roller 118 relative to the support rollers prevents excessive belt walk and maintains the belt on the support rollers during image cycling. As is well known in the art, image cycling includes forming an electrostatic latent image on a belt, developing the electrostatic latent image with toner to form a toner image corresponding to the latent image, transferring the toner image to a receiving member, and repeating the forming, developing and transferring steps at least once. The periodic tilting of belt steering and tension applying roller 118 repeatedly imposes a belt direction tension distribution, which departs from the original uniform applied belt tension, with the lowest value at the longitudinal centerline of belt 10 and gradual increases in intensity which peak at both edges 110 and 112 of belt 10. As a consequence, a compression strain directed transversely toward the center from both edges of the belt is generated and added to the inherent strain in the charge transport layer. The compression strain repeatedly generated toward the center of the belt peaks at about 0.6 percent. Conventional belts in the free state possess an inherent strain in the charge transport of at least about 0.28 percent. Since the tilting of belt steering and tension applying roller 118 repeatedly generates a cross belt compression strain, this compression strain is added to any inherent strain in the belt 10. Therefore if the inherent strain is too high, a threshold is exceeded that leads to the formation of ripples during cycling. Thus, the avoidance of ripple formation in belts during cycling in imaging systems utilizing steering rollers can be achieved with the imaging belt of this invention having a charge transport layer tension strain of less than about 0.05 percent across the width of the belt. Conventional photoreceptor belts generally-have a charge transport layer tension strain of at least about 0.28 percent across the width of the belt. Any suitable electrophotographic imaging belt transport system with a belt steering roller may by utilized in the imaging process of this invention. Typical electrophotographic imaging belt transport systems utilizing a belt steering roller are described in U.S. Pat. No. 4,174,171, U.S. Pat. No. 4,344,693 and U.S. Pat. No. 4,061,222, the entire disclosures of these patents being incorporated herein by reference.

The common problem of imaging member belt surface cracking upon exposure to liquid developers and belt fatigue during imaging cycling is totally eliminated. In yet another embodiment, imaging member belts using an electrically active charge transport polymer layer and fabricated according to the process of the present invention is observed to withstand belt fatigue cycling in a two 1 inch (2.54 cm) diameter roller belt module with constant exposure to liquid developer without developing charge transport layer cracking in up to 300,000 cycles of testing. A respective control imaging member belt shows instantaneous charge transport layer cracking when it is bent over a 1 inch (2.54 cm) diameter roller and exposed to the liquid developer.

This invention will further be illustrated in the following, non-limiting examples, it being understood that these examples re intended to be illustrative only and that the invention is not intended to be limited to the materials, conditions, process parameters and the like recited therein.

EXAMPLE I

A photoconductive imaging member web was prepared by providing a titanium coated polyester substrate having a thickness of 3 mils (76.2 micrometers) and applying thereto a siloxane hole blocking layer having a dry thickness of 0.05 micrometer. An adhesive interface layer of dupont 49,000 polyester was then prepared by applying to the hole blocking layer a polyester adhesive having a dry thickness of 0.07 micrometer. The adhesive interface layer was thereafter coated with a charge generating layer containing 7.5 percent by volume trigonal selenium, 25 percent by volume N,N'-diphenyl-N,N'-bis(3-methylphenyl)-1,1'-biphenyl-4,4'-diamine, and 67.5 percent by volume polyvinylcarbazole. This charge generating layer had a dry thickness of 2.0 micrometers. This coated imaging member web was overcoated by extruding a charge transport layer coating material. The charge transport layer contained N,N'-diphenyl-N,N'-bis(3-methylphenyl)-1,1'-biphenyl-4,4'-diamine and Makrolon 5705, a polycarbonate resin at a weight ratio of 1:1. The charge transport layer had a thickness of 24 micrometers after drying. This imaging member web exhibited spontaneous upward curling when in unrestrained free state. To achieve the desired imaging member flat shape, a 13.8 micrometer thick anti-curl backing layer containing 90 weight per cent Makrolon 5705 polycarbonate resin, 8 weight percent of Goodyear polyester Vitel PE-200 and 2 weight percent of silane treated microcrystalline silica was applied to the rear surface (side opposite the photogenerator layer and charge transport layer) of the photoconductive imaging member web, i.e. on the uncoated side of the polyester substrate layer. The final dried photoconductive imaging member web had a total thickness of about 116 micrometers.

EXAMPLE II

A photoconductive imaging member web was prepared using the same material and following the same procedures as described in Example I, except that the application of the anti-curl backing layer was intentionally omitted.

EXAMPLE III

To remove the upward curling effect exhibited by the imaging . member of Example II, four strips of 2 inch (5.08 cm) wide by 6 inch (15.24 cm) long rectangular shaped imaging samples .were cut from the photoconductive imaging member web of Example II. With the charge transport layer facing outwardly, each imaging sample strip was rolled into a 0.75 inch (19 mm) diameter tube, brought to an elevated temperature of 100° C. in an air circulating oven, and thereafter cooled to room ambient temperature while in the tube shape.

EXAMPLE IV

The photoconductive imaging member web of Example I was cut to provide four strips of 2 inch (5.08 cm) wide by 6 inch (15.24 cm) long rectangular shaped imaging samples. For each set of two imaging sample strips, the cut end of one sample strip was overlapped for a distance of about one millimeter over the other cut end of its corresponding sample strip, in a manner similar to that illustrated in FIG. 1, and joined by conventional ultrasonic welding techniques using 40 KHz sonic energy supplied to a welding horn to form a control seam similar to that illustrated in FIG. 2. In the same manner, the imaging sample strips of Example III were also fabricated into an ultrasonic welded seam shown in FIG. 4.

For seam rupture elongation, rupture strength, overlap thickness, and splash dimensions determinations, the following testing procedures were followed using an Instron Tensile Tester (Model TM, available from Instron Corporation):

(a) A strip of test sample was cut for each of the seam configurations of the above Examples. Each test sample had the dimensions of 1.27 cm×10.16 cm (0.5 in.×4 in.) with the seam situated at the middle of the test sample.

(b) The test sample was inserted into the Instron jaws using a 5.08 cm (2 inch) gage length and seam positioned at the middle between the jaws.

(c) The seam sample was pulled at a cross-head speed of 5.08 cm/minute (2 in./minute), a chart speed at 5.08 cm/minute (2 in./minute), and a calibration of 22 kilograms (50 pounds) full scale to observe for tensile seam rupture as well as seam cracking/delamination.

(d) The load, in kilograms, required to rupture the seam was divided by 1.27 cm (0.5 in.) to obtain the seam rupture strength in Kgs/cm.

(e) The elongation at which seam cracking/delamination occurred was divided by the gaged length of the sample to obtain cracking/delamination strain.

The mechanical measurement results summarized in Table I below show that the seam rupture elongation, and rupture strength, as well as the normalized energy absorption for the seam configuration fabricated using the imaging member without the anti-curl backing layer of Example III, were slightly enhanced compared to the control seam. The seam overlap was measured using a micrometer and the results given in the table showed approximately a 15 percent thickness reduction for the seamed imaging sample having no anti-curl backing layer.

When probed with a three dimensional surface analyzer (Model T-4000, available from Hommel Amerca, Inc.) the control seam had a rectangular shape splash and with dimensions signficantly greater than those of the seam of the invention imaging member which yielded a tapered splash morphology.

TABLE I

| Seamed Imaging | Break Elongation (%) | Break Strength (Kgs/cm) | Energy Absorbent (%) | Overlap Thickness (μ) | Seam Splash Height (μ) | Seam Splash Length (cm) |
|---|---|---|---|---|---|---|
| Example I | 9.8 | 10.1 | 100 | 102 | 65 | 0.8 |
| Example II | 11.2 | 11.8 | 134 | 87 | 53 | 0.5 |

Since the imaging member of the present invention may be free of an anti-curl backing layer, it has one less coating layer to melt during ultrasonic seam welding process. Therefore, more kinetic energy provided by the mechanical action of the horn is available for absorption at the overlap joint to effect substrate to a substrate fusing. This is reflected by the overall seam mechanical enhancement and splash size reduction listed in the table above.

Dynamic fatigue endurance testing was also carried out to establish respective seam performance comparison. With a one pound weight attached at one end to provide a one lb/in. width tension, the test sample with the seam was 180° wrapped over a 3.0 in. (0.12 millimeter) diameter free rotating roller and the opposite end of the test sample was gripped by hand. Under these conditions, the seam of the test sample was dynamically flexed back and forth over the roller by manually moving the hand up and down, at a rate of one flex per second, until seam cracking/delamination occurred. Although the results obtained from this test show that the control seam developed total seam cracking/delamination after only 8 cycles of flexing the seam configuration of the imaging member of this invention was more mechanically robust to resist fatigue seam failure and outlasted the control seam by 49 cyclic flexes until it exhibited delamination. This dynamic fatigue seam life improvement was achieved by decreasing the seam thickness and splash size resulted in the reduction in seam bending stress, thereby extending the mechanical functioning life of the seam.

EXAMPLE V

Photoconductive imaging member webs of Examples I and II were each cut to provide a rectangular sheet having the dimensions of 13.78 inch (350 mm) by 32.95 inch (837 mm) length for ultrasonic seam welding into imaging member belts according to the seam fabrication method described in Example IV. For the photoconductive imaging member sheet of Example II, the upward curling of the imaging member sheet was removed by following the procedures of the charge transport layer stress release process prior to the seam welding operation.

When cycled in a belt support module, employing an active steering/tension roll for belt walk control, the imaging belt of Example I was seen to exhibit the onset of ripple formations after only about 180 cycles whereas the imaging member belt of the present invention remained free from ripple defect development up to 30,000 cycles of testing. The cycling process repeatedly applied a cross belt compression strain distributed in an arcuate gradient of increasing intensity from the longitudinal centerline of the belt to each of the edges of the belt, the strain applied at each of the edges of the belt repeatedly peaking to an intensity at the longitudinal edges of at least about 0.6 percent greater than the strain applied to the centerline of the belt.

EXAMPLE VI

A photoconductive imaging member web was prepared according to the procedures and using the same materials as described in Example I, except that the charge generating layer was substituted by a 1 micrometer thick charge generating layer containing hydroxy gallium phthalocyanine in polystyrene-polyvinylpyridine block copolymer binder and the charge transport layer was replaced by a hole transporting active polymer of poly(ether carbonate). This poly(ether carbonate) was a polymer of N,N'-diphenyl-N,N'-bis[3-hydroxyphenyl]-[1,1'-biphenyl]-4,4'-diamine and diethylene glycol bischloroformate described in U.S. Pat. No. 4,806,443, the entire disclosure thereof being incorporated herein by reference.

EXAMPLE VII

A photoconductive imaging member web was prepared in exactly the same manner as described in Example VI, except that the anti-curl backing layer was intentionally omitted. A rectangular imaging sample strip of 2 inches (5.08 cm) by 12 inches (30.48 cm) was cut from the imaging member web and then subjected to the charge transport layer stress release process, by following the procedures described in Example III, to eliminate the upward curling effect of the imaging member sample.

EXAMPLE VIII

A photoconductive imaging member web was prepared according to the procedures and using the same materials as described in Example VI, except that the charge transport layer comprised polysebacoyl, a hole transporting polymeric material of N,N'-diphenyl-N,N'-bis[3-hydroxyphenyl]-[1-1' biphenyl]-4,4' diamine and sebacoyl chloride described in U.S. Pat. No. 5,262,512, the entire disclosure thereof being incorporated herein by reference.

EXAMPLE IX

A photoconductive imaging member web was prepared in the same manner as described in Example VIII, except that the application of the anti-curl backing layer was intentionally omitted. A rectangular imaging sample strip 2 inches (5.08 cm) wide by 12 inches (30.48 cm) long was cut from the imaging member web and then subjected to the charge transport layer stress release process, by following the procedures described in Example III, to remove the upward curling effect in the imaging sample.

EXAMPLE X

A rectangular imaging sample strip of 2 inches 5.08 cm) wide by 12 inches (30.48 cm) long was cut from each photoconductive imaging member web of Examples VI and VIII. Along with the imaging sample strips of Examples VII and IX, they were each ultrasonically welded into four individual seamed imaging member belts according to the procedures described in Example IV.

Each individual imaging belt was mounted onto a two 1 inch bi-roller belt support module for a Norpar 15 (a high boiling hydrocarbon liquid available from EXXON Chemicals) exposure and fatigue cycling test. Both imaging belts fabricated with imaging members of Examples VI and VIII were used to serve as controls for comparison. The exposure and fatigue testing results showed that Norpar 15 exposure was detrimental to the control imaging belts because both poly(ether carbonate) and polysebacoyl charge transport layers were seen to develop instantaneous cracking upon exposure to Norpar 15 liquid while bent passing over each 2 inch diameter belt support roller. In sharp contrast, the imaging belts of Examples VIII and IX which had been previously subjected to a charge transport layer stress release process, were absolutely free of charge transport layer cracking after 300,000 fatigue cycles and constant Norpar 15 liquid contact. These results demonstrated the effectiveness of the process of the present invention including fabrication of a structurally simplified imaging member as well as using the resulting imaging member in an imaging process which repeatedly applies a cross belt compression strain distributed in an arcuate gradient of increasing intensity from the longitudinal centerline of the belt to each of the edges of the belt, said strain applied at each of said edges of said belt repeatedly peaking to an intensity at said longitudinal edges of at least about 0.6 percent greater than the strain applied to said centerline of said belt.

While the embodiments disclosed herein are preferred, it will be appreciated from this teaching that various alternative, modifications, variations or improvements therein may be made by those skilled in the art, which are intended to be encompassed by the following claims.

What is claimed is:

1. A process comprising providing a flexible electrostatographic imaging belt comprising a substrate layer, a charge generating layer, charge transport layer, and two parallel longitudinal edges, said imaging belt having a charge transport layer tension strain of less than about 0.05 percent across the width of said belt, mounting said imaging belt on at least one support roller and a belt steering and tension applying roller substantially parallel to and spaced from said support roller to guide said belt, transporting said belt around said support roller and said belt steering and tension applying roller, periodically tilting said belt steering roller relative to said support roller to maintain said belt on said support roller, forming an electrostatic latent image on said belt, developing said electrostatic latent image with toner to form a toner image corresponding to said latent image, transferring said toner image to a receiving member, and repeating said forming, developing and transferring steps at least once.

2. A process according to claim 1 wherein said belt is free of an anti-curl backing layer.

3. A process according to claim 2 wherein said imaging belt is fabricated by providing a web substrate free of an anti-curl backing layer on one side, applying coatings comprising a charge generating layer and charge transport on the opposite side of said substrate to form an electrostatographic imaging web, drying said belt while said belt is still at substantially said elevated temperature, bringing said substrate of said belt into intimate contact through at least a 180° arc with the exterior surface of a chill roller having a diameter of between about 15 millimeters and about 30 millimeters to quench said electrostatographic imaging web, forming said electrostatographic imaging belt from said web to form said belt is free of an anti-curl backing layer.

4. A process comprising providing a flexible electrostatographic imaging belt comprising a substrate layer, a charge generating layer, charge transport layer, and two parallel longitudinal edges, said imaging belt having a charge transport layer tension strain of less than about 0.05 percent across the width of said belt, mounting said imaging belt on a plurality of spaced apart support rollers, transporting said belt around said support rollers, repeatedly imposing a belt direction tension of increasing intensity from the longitudinal centerline of said belt to each of said edges of said belt, said tension imposed at each of said edges of said belt repeatedly peaking to an intensity at said longitudinal edges of at least about 0.6 percent compression strain directed transversely toward said centerline of said belt, forming an electrostatic latent image on said belt, developing said electrostatic latent image with toner to form a toner image corresponding to said latent image, transferring said toner image to a receiving member, and repeating said forming, developing and transferring steps at least once.

5. A process according to claim 4 wherein said belt is free of an anti-curl backing layer.

6. A process comprising providing a flexible electrostatographic imaging belt comprising a substrate layer, an imaging layer and two parallel longitudinal edges, said imaging belt having a charge transport layer tension strain of less than about 0.05 percent across the width of said belt, mounting said imaging belt on at least one support roller and a belt steering and tension applying roller substantially parallel to and spaced from said support roller to guide said belt, transporting said belt around said support roller and said belt steering and tension applying roller, periodically tilting said belt guiding roller relative to said support roller to maintain said belt on said support roller, forming an electrostatic latent image on said belt, developing said electrostatic latent image with toner to form a toner image corresponding to said latent image, transferring said toner image to a receiving member, and repeating said forming, developing and transferring steps at least once.

7. A process according to claim 6 wherein said belt is free of an anti-curl backing layer.

8. A process according to claim 6 wherein said imaging layer is an electrographic dielectric imaging layer.

9. A process according to claim 6 wherein said flexible electrostatographic imaging belt has parallel edges and, in an unrestrained free state, assumes an arc shape having a radius of curvature between about 0.76 cm and about 1.52 cm measured from an imaginary center axis to an exposed surface of said substrate layer, said axis being substantially perpendicular to said parallel edges.

* * * * *